US006860088B2

(12) United States Patent
Goodman

(10) Patent No.: US 6,860,088 B2
(45) Date of Patent: Mar. 1, 2005

(54) HORIZONTAL ROBOTIC PACKING SYSTEM

(75) Inventor: James A. Goodman, Glenloe, FL (US)

(73) Assignee: Prototype Equipment Corporation, Waukegan, IL (US)

( * ) Notice: Subject to any disclaimer, the term of this patent is extended or adjusted under 35 U.S.C. 154(b) by 0 days.

(21) Appl. No.: 10/230,737

(22) Filed: Aug. 28, 2002

(65) Prior Publication Data

US 2003/0046904 A1 Mar. 13, 2003

Related U.S. Application Data

(60) Provisional application No. 60/318,102, filed on Sep. 7, 2001.

(51) Int. Cl.[7] ..... B65B 21/06

(52) U.S. Cl. ..... 53/443; 53/235; 53/244; 53/245; 53/249; 53/250; 53/251; 53/475

(58) Field of Search ..... 53/244, 235, 249, 53/250, 251, 443, 446, 474, 475, 245

(56) References Cited

U.S. PATENT DOCUMENTS

| | | | | |
|---|---|---|---|---|
| 4,137,604 A | * | 2/1979 | Sandberg et al. | 99/450.1 |
| 4,507,908 A | | 4/1985 | Seragnoli | |
| 4,510,730 A | | 4/1985 | Edmondson | |
| 4,583,351 A | | 4/1986 | Fallas | |
| 4,611,458 A | | 9/1986 | Prakken | |
| 4,633,653 A | | 1/1987 | Roberts et al. | |
| 4,754,598 A | * | 7/1988 | Wild | 53/497 |
| 4,800,703 A | | 1/1989 | Goodman | |
| 4,864,801 A | | 9/1989 | Fallas | |
| 5,123,231 A | | 6/1992 | Fallas et al. | |
| 5,155,967 A | | 10/1992 | Branson | |
| 5,251,422 A | | 10/1993 | Goodman et al. | |
| 5,326,218 A | | 7/1994 | Fallas | |
| 5,369,932 A | * | 12/1994 | Passero | 53/260 |
| 5,415,518 A | | 5/1995 | Montgomery | |
| 5,588,285 A | | 12/1996 | Odenthal | |
| 5,611,193 A | * | 3/1997 | Farrelly | 53/475 |
| 5,655,355 A | | 8/1997 | Ramler | |
| 5,680,746 A | | 10/1997 | Hornisch | |
| 5,855,105 A | | 1/1999 | Ferris | |
| 6,003,284 A | | 12/1999 | Goodman | |
| 6,209,293 B1 | * | 4/2001 | Powers | 53/475 |
| 6,430,895 B1 | | 8/2002 | Kitagawa et al. | |
| 6,533,533 B1 | * | 3/2003 | Heston | 414/791.6 |

* cited by examiner

*Primary Examiner*—Eugene Kim
*Assistant Examiner*—Christopher Harmon
(74) *Attorney, Agent, or Firm*—Brinks Hofer Gilson & Lione

(57) ABSTRACT

This machine can automatically load packages of various sizes and shapes into containers in a variety of pack patterns. The machine has a package infeed system that transfers the package to a package locating system that locates the package at a stationary package placement location. A package placement vertical drive picks up the package from the stationary package placement location and can rotate the package about a vertical axis as well as lowering the package into the container and releasing it at the proper location. The package placement vertical drive grips the package by vacuum. It includes a quick attach and detach vacuum head which enables the rapid change-over of the system. The machine includes a case conveyor that moves the container along the longitudinal axis of the machine as well as to the left or right in a direction normal to the longitudinal axis of the machine. This machine, along with the method performed by this machine, has the ability to perform several functions simultaneously which enables it to operate at high speeds.

30 Claims, 13 Drawing Sheets

405
413
100
401
413
10
602
400
414
416
12
300
402
5
30
304
5
308
302
306
60
20
200
204
202
212
205
206
208
210

100
600
10
602
312
50
306
318

10
100
10A
11A
12A
13A
20
30
202
401
402
348
310

HORIZONTAL ROBOTIC PACKING SYSTEM

This nonprovisional application claims the benefit of provisional application No. 60/318,102 that was filed on Sep. 7, 2001.

BACKGROUND OF THE INVENTION

The invention relates to a pick-and-place machine and method for packaging products, such as filled, sealed packages, into cases. More specifically, the invention relates to a system that can pick up packaged products of any size or shape and then place the package into a case of any size or shape in a selected packaging sequence or patterns. Packages of products, for example, potato chips or other snack foods, are of a general pillow-shape rather than square or rectangular, and the product contained in the packages are delicate and breakable. The delicate products contained in these packages can be damaged if when conveying the package horizontally the package is accelerated or decelerated excessively. The packing order or patterns for such packages must be designed to prevent the packages from shifting around within the closed cases. Successful pack patterns frequently require the packages to overlie or overlap, and alternate layers to be different. A machine for packaging packages such as this is disclosed in U.S. Pat. No. 6,003,286. Although the machine disclosed in this patent has been very successful, it is a large machine, its speed is limited, and change-over from one package and container to a different package and container is time-consuming.

SUMMARY OF THE INVENTION

This invention comprises a pick-and-place robotic machine that will load and unload packages into containers and the method for loading and unloading packages into containers in a way that overcomes the limitations of the prior art machines. This machine and method conveys the packages horizontally to a position under a robotic head in a motion having no abrupt accelerations or decelerations and thus minimizes damage to the delicate products. This machine and method move the container into position under a robotic head while the robotic head remains stationary. As a result, the machine of this invention is very stable and the size or "footprint" of the machine is smaller than existing machines that pick up a package, move the package horizontally and then place the package vertically into the container. Several motions occur simultaneously during the operation of applicant's machine and contribute to the improvement of this machine over the prior art machines.

It is important that pick and place machines of the type disclosed herein are versatile to enable them to process a large variety of products, place the products in containers of various sizes and in selected pack patterns.

The machine and method of this invention include a container or case conveyor that is capable of moving the container in either direction along the longitudinal axis of the conveyor as well as shifting the container to the left or right in a direction normal to the longitudinal axis of the conveyor.

The machine and method of this invention also include a package infeed system including a constant motion band conveyor and a vacuum transfer mechanism which lifts the package from the band conveyor and transfers it horizontally to a stationary package placement location. The speed of the band conveyor is adjustable, and the vacuum transfer mechanism is programmed to accommodate packages of the size being processed. The vacuum transfer mechanism functions to lift the package off the band conveyor and thus transfers control of a package from the band conveyor to the vacuum transfer mechanism.

The machine of this invention further includes a package placement vertical drive which rotates the package about a vertical axis as well as lowers the package into the container and releases it at the proper elevation. The package placement vertical drive grips the package by vacuum and includes a quick attach and detach vacuum head which enables the rapid change-over of the system.

The machine and method of this invention have a smaller footprint that requires less floor space than prior art machines of comparable capacities. Also, the machine is very stable and durable. The machine and method of this invention can place packages into containers in predetermined patterns faster than the prior art machines, as a result of the ability to perform several motions simultaneously. Another advantage of this machine over the prior art is that it can be quickly and easily changed over between different size packages, different patterns and different containers, and it has the ability to place the packages in a container in any pack pattern. In addition, the machine is designed for the sanitary conditions necessary in the food industry. Its construction of aluminum and stainless steel enables the machine to be washed down.

BRIEF DESCRIPTION OF THE DRAWINGS

FIG. 14 is a view, similar to FIG. 5, of another embodiment of the invention.

FIG. 15 is an isolated view of the package locating system that includes a different embodiment of the horizontally extending members than shown in FIG. 14.

FIG. 16 is an isolated side view of the package infeed system used with the embodiment shown in FIG. 14.

FIG. 17 is an isolated front view of the package infeed system shown in FIG. 16.

FIG. 18 is a right-side view of the machine showing the mechanism for opening and closing the package slide members.

FIG. 19 is an isolated plan view of the vacuum stop and placement member.

FIG. 20 is a right-side view of the machine showing the vacuum stop and placement member.

DETAILED DESCRIPTION OF THE INVENTION

Hereinafter, embodiments of the present invention will be described with reference to the accompanying drawings;

however, the present invention can be implemented in a number of ways and is not limited to the embodiments described below.

Figure 1:
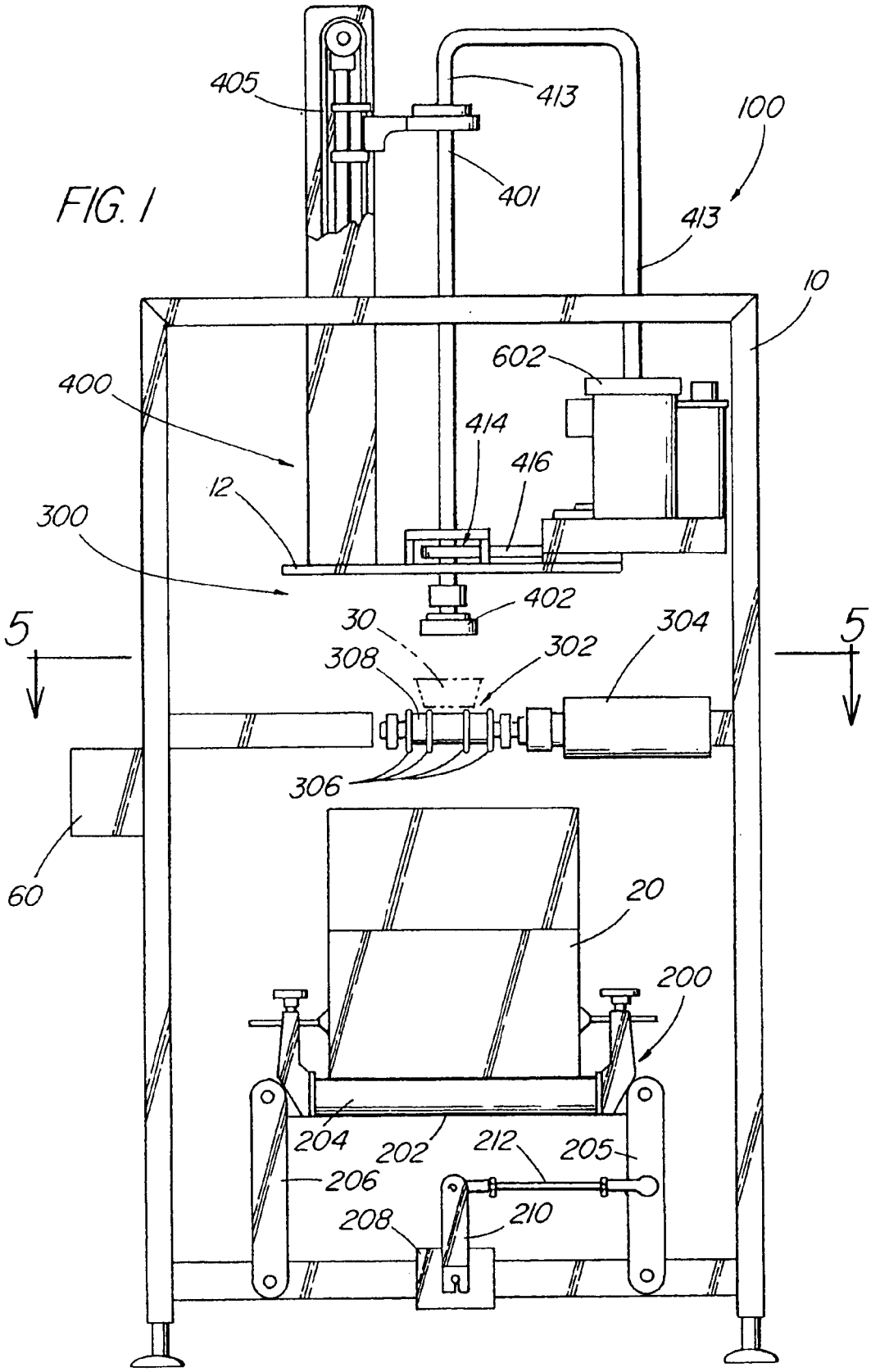
FIG. 1 is a front schematic view of the machine.

Referring now to FIG. 1, wherein a front view of the pick and place robotic machine 100 of this invention is shown. The machine 100 has a main frame 10 that supports a detection system 50, container or case conveyor 200, a package infeed system 300 and a package placement vertical drive system 400. The container or case conveyor 200, package infeed system 300 and a package placement vertical drive system 400 are each driven by servo motors or pneumatic activators that are, along with the detection system 50, operatively associated with a programmable logic controller (PLC) 60 that controls the sequential operation of the operative components.

Figure 3:
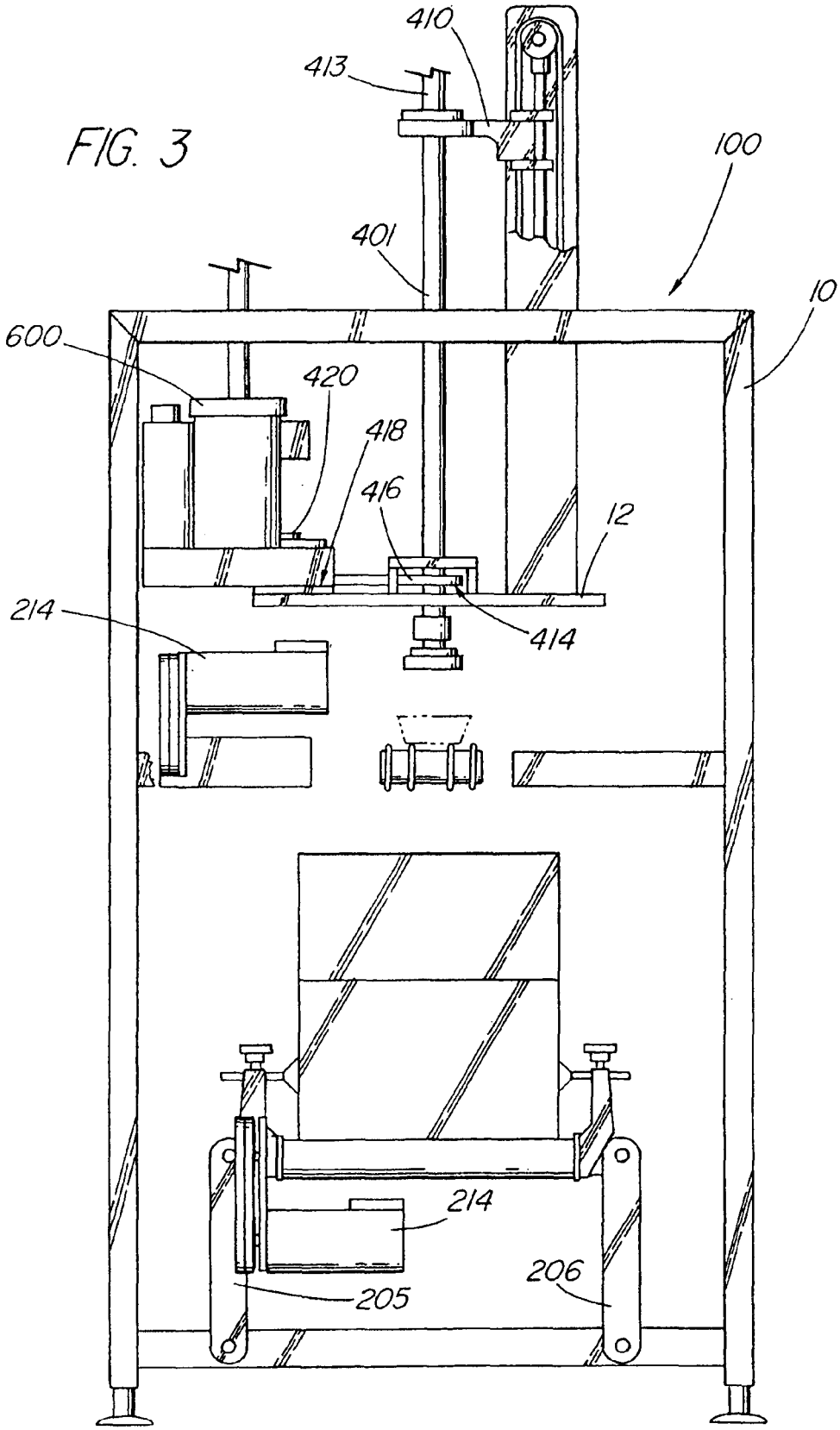
FIG. 3 is a back schematic view of the machine.

The container or case conveyor 200, has a horizontal belt conveyor 202 carried by a frame 204. The horizontal belt conveyor 202 functions to move containers or cases 20 in either direction along its longitudinal extent that extends from the front to the back of the machine 100. The servo motor 214 for driving the horizontal belt conveyor is best seen in FIG. 3, which is a back view of the machine 100. The frame 204 for the case conveyor is supported at the front and back of the machine 100 by pairs of links 205 and 206. Links 205 and 206 are pivotally connected to the main frame 10 at their lower extremity and to the frames 204 at their upper extremity, such that the links 205, 206 and frames 10 and 204 function as a four-bar linkage, allowing the frame 204 to move to the right or left of its central location while being maintained horizontal. As best seen in FIG. 1, the movement of the container or case conveyor between its extreme left, central and extreme right locations is controlled by a servo motor 208 that is carried by the main frame 10. Servo motor 208 has a lever 210 rigidly secured to its output shaft, the free end of which is pivotally connected to an adjustable length bar 212. The other end of adjustable length bar 212 is pivotally connected to link 205. As a result of this mechanism, the servo motor 208 can, in response to a signal from the PLC 60, move the location of the container or case conveyor 200 to any location between its extreme left position and its extreme right position. The extreme left and right positions of the container or case conveyor 200 are within the confines of the main frame 10. As seen in FIG. 1, the case conveyor 200 is at a central location between the right and left extreme locations. As a result, the container or case conveyor 200 is capable of locating a container or case 20 anywhere along its longitudinal extent and between its left and right extreme locations.

A portion of an embodiment of the package infeed system 300 is seen in FIG. 1. A front end view of the constant motion band conveyor 302 and the motor 304 that drives it are seen in FIG. 1. The end of the constant motion band conveyor 302 seen in FIG. 1 includes a spool-like member 308 having grooves formed therein for receiving four bands 306.

A conveyor (not shown) feeds packages 30 to the front end of the constant motion band conveyor 302, which packages are detected by the detection system 50 which sends a signal to the PLC 60 indicating the arrival of a package 30.

Figure 2:
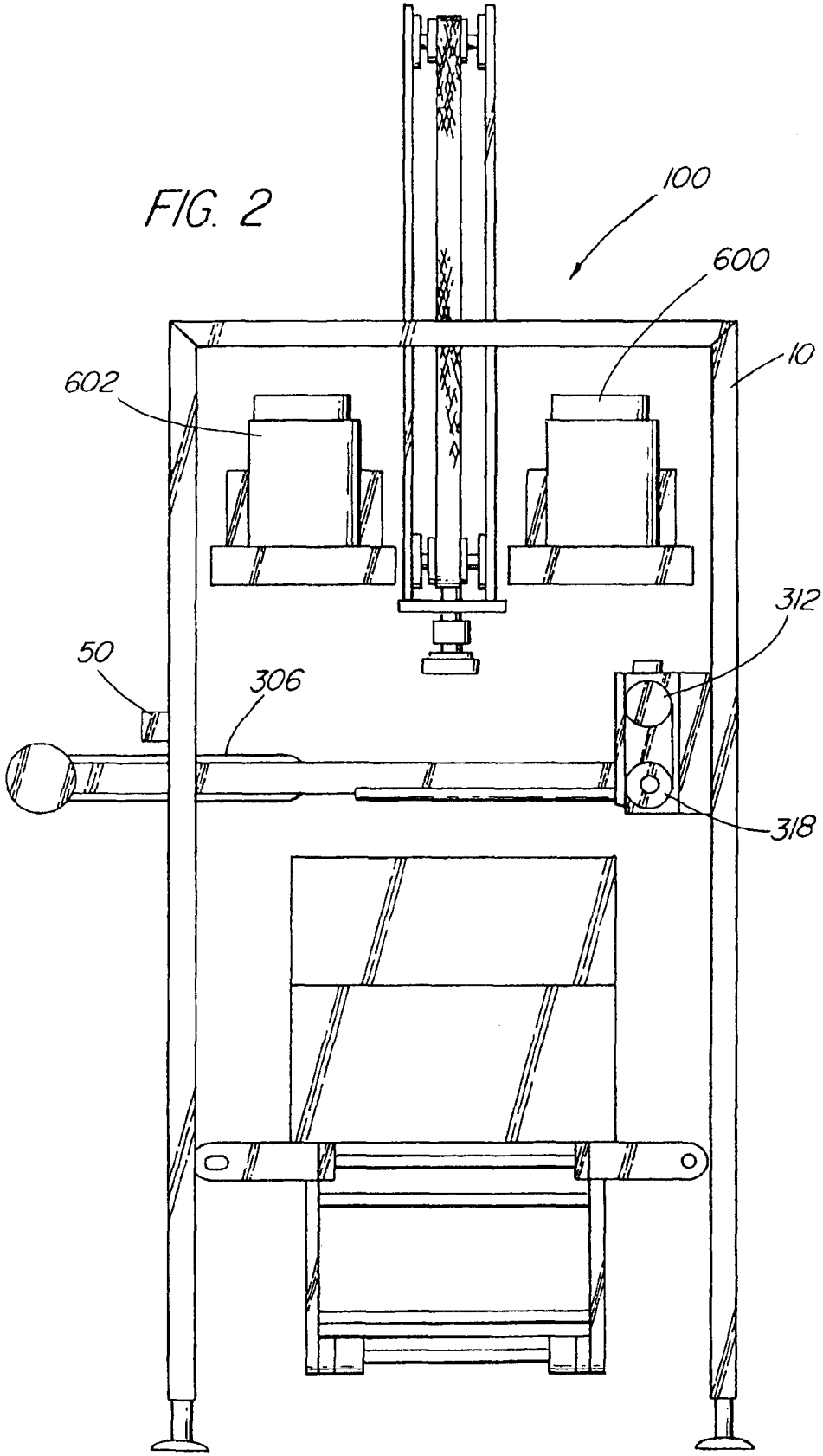
FIG. 2 is a right-side schematic view of the machine.

The package infeed system 300 has a package locating system 360 that in this embodiment includes a vacuum transfer mechanism 310 (see FIGS. 5 and 6), which grips the package by vacuum, lifts the package from the band conveyor 302 and then transfers it horizontally toward the back of the machine 100 to a stationary package placement location 500. The vacuum transfer mechanism then releases its vacuum grip of the package 30. The speed of the band conveyor 302 is constant but can be adjusted and the vacuum level of the vacuum transfer mechanism 310 can be adjusted to accommodate the size and weight of the packages 30 being processed. The vacuum transfer mechanism 310 functions to lift the package 30 off the band conveyor 302 and thus transfers control of a package from the band conveyor 302 to the vacuum transfer mechanism 310. The servo motor 312 for moving the vacuum transfer mechanism 310 fore and aft of the machine 100 is shown in FIG. 2, which is the right side view of the machine 100.

Figure 4:
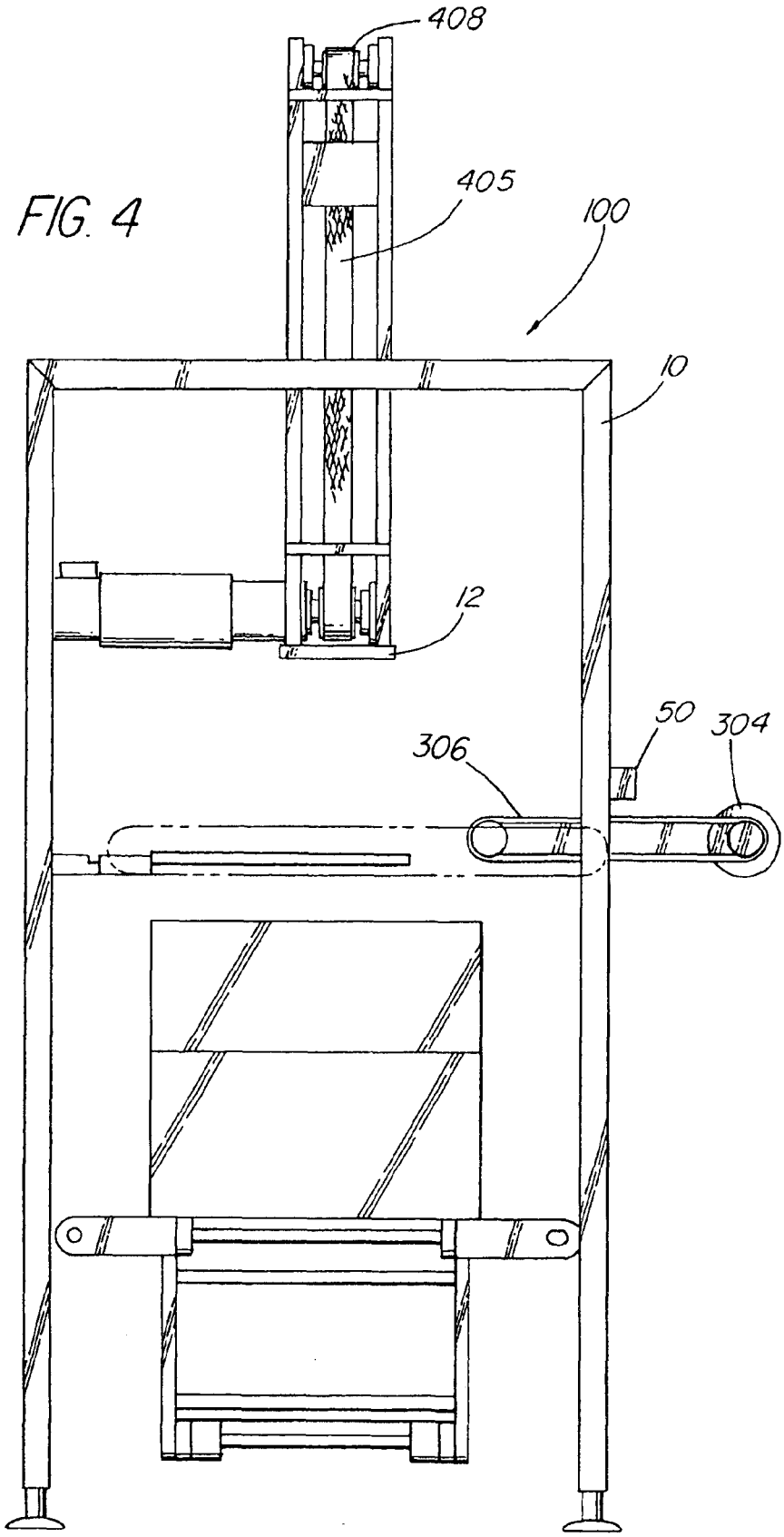
FIG. 4 is a left-side schematic view of the machine.

Also seen in FIG. 1 is the package placement vertical drive system 400 which lifts the package 30 from the vacuum transfer mechanism 310, rotates the package 30 about a vertical axis when required by the packaging pattern, and then lowers the package 30 into a container 20 and releases it at the proper elevation. The package placement vertical drive system 400 is carried by a support 12 that extends from the main frame 10. The vacuum transfer mechanism 310 is returned to the front of the machine 100 after the package 30 is lifted by the package placement vertical drive system 400 at the stationary package placement location 500. This allows the package placement vertical drive system 400 to lower the package into the container 20. The servo motor 404 for raising and lowering the package placement vertical drive system 400 is shown in FIG. 4, which is the left side view of the machine 100. The package placement vertical drive system 400 grips the package by vacuum and includes a quick attach and detach vacuum head 402 which enables a rapid change-over of the system. Vacuum heads 402 of various sizes and shapes can be quickly secured to the package placement vertical drive system 400. The servo motor 404 drives a drive sprocket 406, mounted on support 12, that drives a timing belt 405 that also extends over an upper sprocket 408. An arm 410 is secured to a portion of the timing belt 405. Through this mechanism, the arm 410 can reciprocate vertically. The other end of arm 410 is connected to a spindle 401 that carries the vacuum head 402 at its lower end. The spindle 401 extends through a driven sprocket 414 that is mounted for rotation on the support 12. The spindle 401 can slide vertically through the center of the driven sprocket 414, however, the cross-section of the spindle and the opening in driven sprocket 414 are such that they must rotate together. The driven spindle 414 carries a timing belt 416 that is driven by a drive spindle 418 that, in turn, is driven by a pneumatic actuator or servo motor 420. Thus, after a package 30 has been picked up by the vacuum head 402, the spindle 401 can be rotated, which rotates the package 30. The mechanism driven by servo motor 404 can then be energized to lower the spindle into the container or case and to deposit the package 30 at the appropriate level. A vacuum tube 413 is connected to the upper end of spindle 401, the other end of which is connected to a vacuum source 602 that is best seen in FIGS. 1 and 2.

Figure 5:
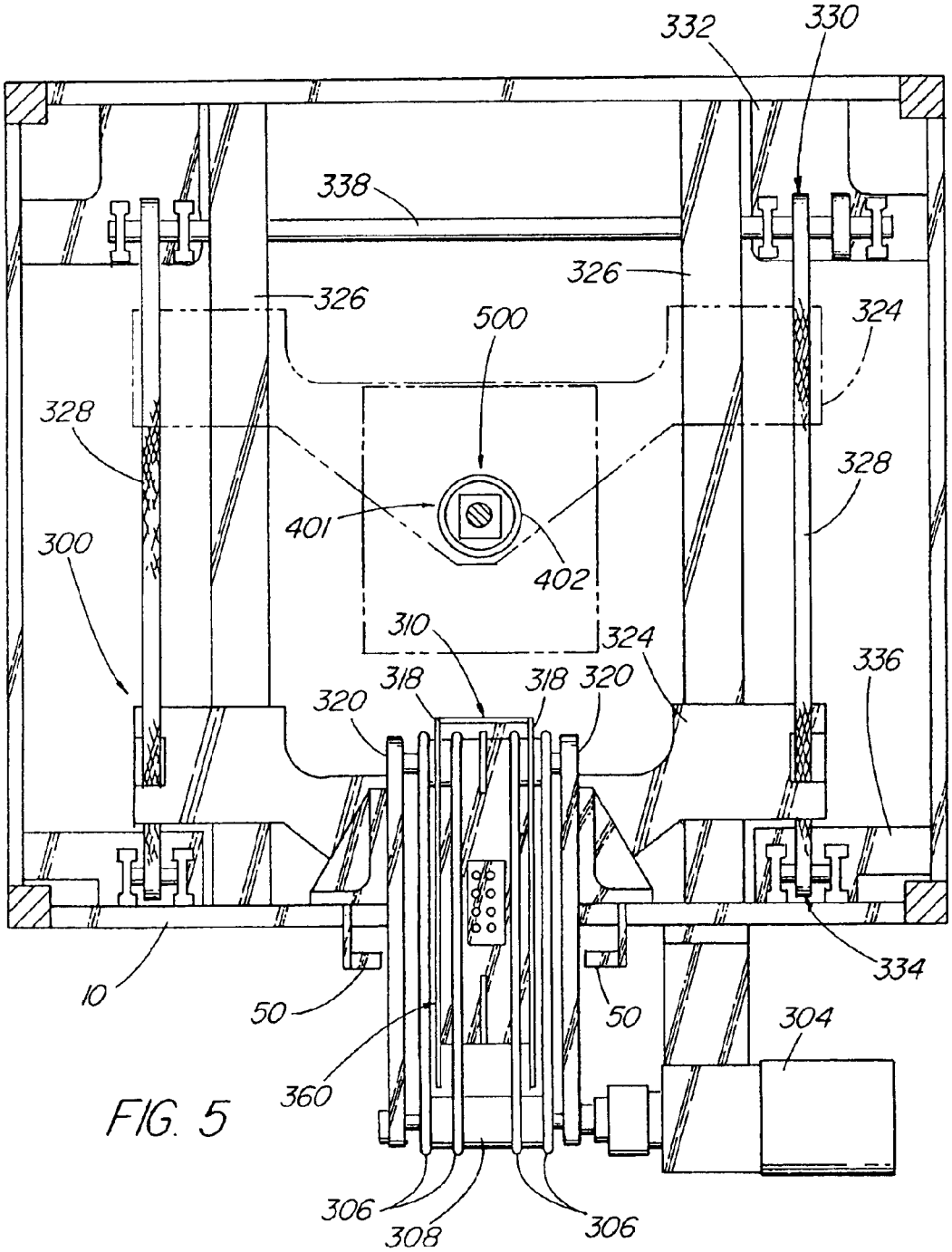
FIG. 5 is a cross-sectional view taken along lines 5—5 of FIG. 1.

FIG. 5 is a cross-section view taken along lines 5—5 of FIG. 1 and shows a top view of this embodiment of the package infeed system 300. The motor 304 that drives the spool-like member 308 and the bands 306 are seen in this view. The bands 306 extend toward the back of the machine where they extend over aligned followers 318 that have groves that receive the bands 306. There is a right and a left follower 318, each of which has two groves for accepting two of the bands 306. The followers 318 and the spool-like member 308 are mounted for rotation on an infeed frame 320 that is supported by the main frame 10. As a result of this mounting arrangement, the constant motion band conveyor 302 is secured to the main frame 10 and does not move relative thereto. It should be noted that the followers 318 do not extend across the infeed system, and as a result, it is open between the two innermost bands 306. The vacuum transfer mechanism 310 is located in this opening between the two innermost bands 306. The vacuum transfer mechanism 310 is formed by a weldment 322 that is secured to a bat wing-shaped mounting plate 324 that is mounted to be slid along a pair of fore and aft extending bars 326. The ends of mounting plate 324 are secured to timing belts 328. The right timing belt 328, as seen in FIG. 5 extends over a driven sprocket 330 that is carried by a mounting plate 332 secured to the main frame 10. The right side timing belt extends over a follower sprocket 334 that is carried by a mounting plate 336 secured to the main frame 10. The driven sprocket 330 is secured to a shaft 338 that is driven through a timing belt by servo motor 312 (see FIG. 2).

In FIG. 5, the bat wing-shaped mounting plate 324 is shown in two locations. The first location is at the front of the machine 100 at which the vacuum transfer mechanism 310 is nested between the bands 306 of the constant motion band conveyor 302. In the second location, it is shown toward the back of the machine. This second location is where the package placement vertical drive system 400 picks up the package 30 from the vacuum transfer mechanism 310. At the second location a top view of the spindle 401 and vacuum head 402 are shown. It should be noted that, in FIG. 5, at the second location of the bat wing-shaped mounting plate 324, in an effort to simplify the drawing, the vacuum transfer mechanism 310 is not shown; however, it is secured to the mounting plate 324 and is moved with mounting plate 324 to this location.

Figure 6:
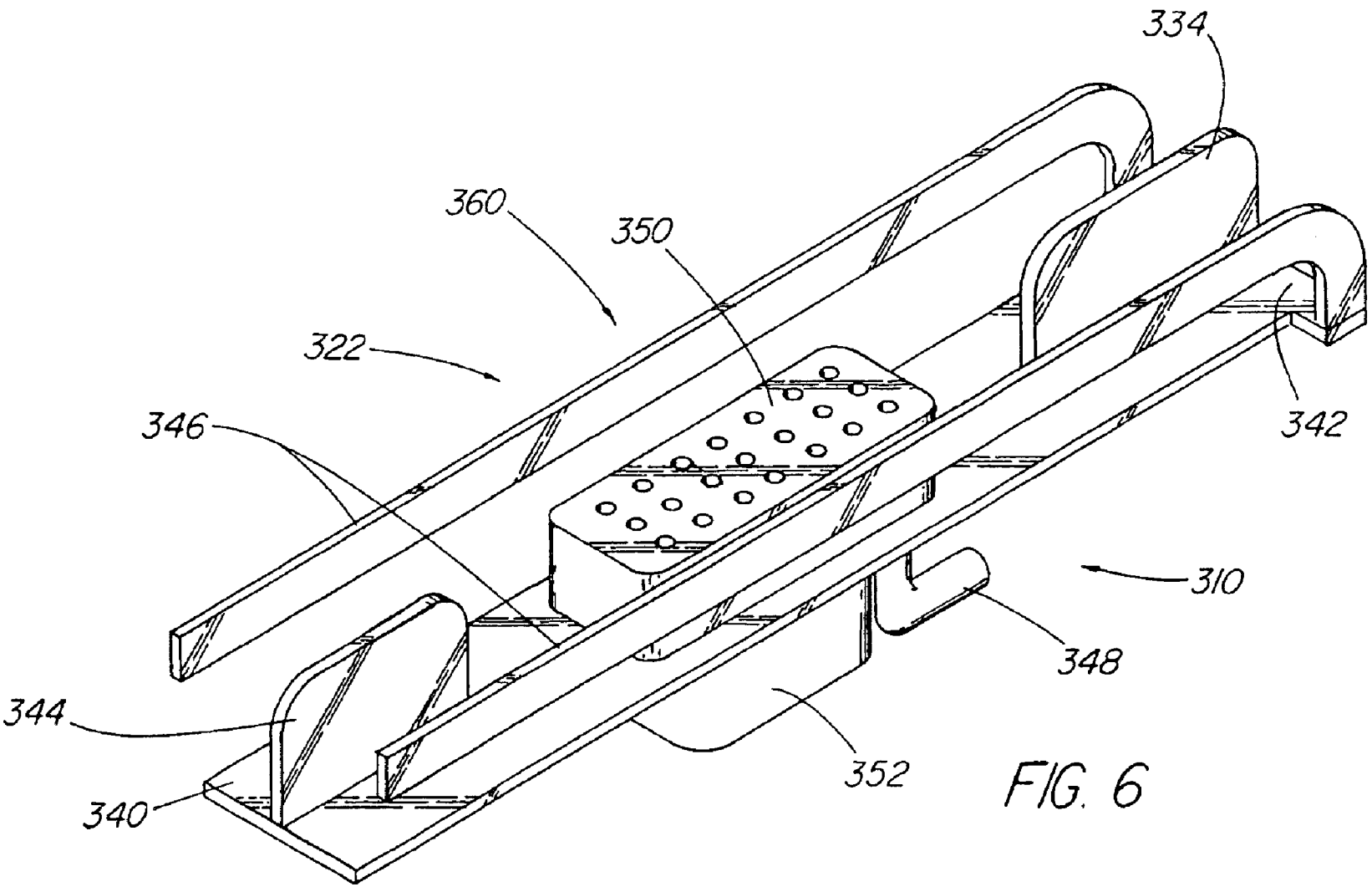
FIG. 6 is an isolated isometric view of the vacuum transfer mechanism.

FIG. 6 is an isolated isometric view of a weldment 322 for the vacuum transfer mechanism 310. The weldment 322 includes bottom bar 340 that is welded to an end plate 342. Welded to the bottom bar 340 are two upright members 344 that add support for larger packages. A pair of bars 346 are welded to the end plate at locations on either side of the bottom bar. An elbow-shaped tube 348 is welded to the bottom of the bottom bar 340 and communicates through an opening in the bottom bar 340 with a vacuum plenum device 350. The vacuum plenum device 350 is carried on the upper surface of bottom bar 340 between the upright members 344. Openings are provided in the upper surface of the vacuum plenum device 350 which enables packages to be grasped when vacuum is applied to the plenum. A flexible tube is connected to the elbow-shaped tube 348, the other end of which is connected to vacuum source 600, best seen in FIG. 2. The cylinder portion of a pneumatic cylinder 352 is secured to the bottom surface of bottom bar 340. The pneumatic cylinder 352 is secured to the bat wing-shaped mounting plate 324. When pneumatic cylinder 352 is energized, the entire weldment 322 is elevated and the package is lifted off the constant motion band conveyor. Pneumatic cylinder 352 is energized in response to the recognition by the detection system 50 that a package 30 is approaching. The PLC 60 is programmed to send a signal to energize cylinder 352 at a predetermined time after it receives a signal from the detection system 50 indicating that a package is approaching. The predetermined time is the elapsed time that it will take the package to travel from the location where it is detected by the detecting system 50 until it is over the perforations in the top of the vacuum plenum device 350. The PLC 60 is also programmed to send a signal to the vacuum source 600, at a predetermined time after a package is recognized to provide a vacuum to vacuum plenum device 350. Openings are provided in the upper surface of the vacuum plenum device 350 which enables packages to be stopped and held after the weldment 322 is elevated, as a result of the expansion of cylinder 352 and the application of a vacuum to the vacuum plenum device 350.

FIGS. 7 through 13 and FIGS. 7A through 13A are a series of schematic views representing the handling sequence of a package after it has been sensed by the detection system 50. FIGS. 7–13 are right side views of the machine 100. FIGS. 7A through 13A are cross-section views taken along lines A—A of FIGS. 7–13.

The packages are fed to the machine 100 by a conventional belt conveyor (not shown) and are sensed by the detection system 50 as they are about to be received by the constant motion band conveyor 302 of the package infeed system. The detection system 50 sends a signal to the PLC 60 which initiates a sequence that is illustrated in FIGS. 7 and 7A through 13 and 13A. In this series of views, the main frame 10 of the machine 100 is shown in all views. The horizontal belt conveyor 202, that supports the container or case 20, is seen in side views FIGS. 7–13 and in top views FIGS. 7A–13A. Side views of the constant motion band conveyor 302 and the vacuum transfer mechanism 310, as well as the spindle 401 and vacuum head 402 of the package placement vertical drive system 400, are shown in FIGS. 7–12. A package 30 is also shown in FIGS. 7–12. In an effort to simplify this series of views, the vacuum plenum device 350 and the pneumatic lifter cylinder 352 for the vacuum transfer mechanism 310 have not been shown in this series of views.

Figure 7A:
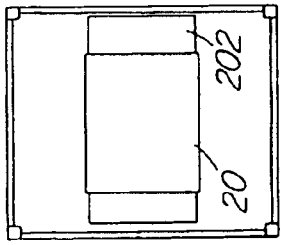
Figure 7:
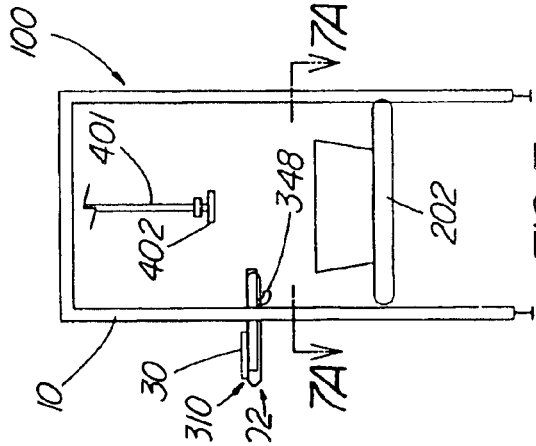

As seen in FIGS. 7 and 7A, the pneumatic cylinder 352 has not been energized, the vacuum to the vacuum plenum device 350 has not been turned on, and the package 30 is at the left end of the constant motion band conveyor 302 and is being conveyed to the right. The pneumatic lifter cylinder 352 is in a waiting mode and has not been activated. The spindle 401 and vacuum head 402 are in their waiting or home positions. The container or case 20 is at the central or home position along the longitudinal axis of the horizontal belt conveyor 202 and the horizontal belt conveyor is at its home or central position.

Figure 8A:
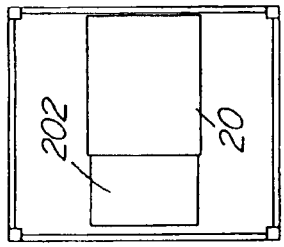
Figure 8:
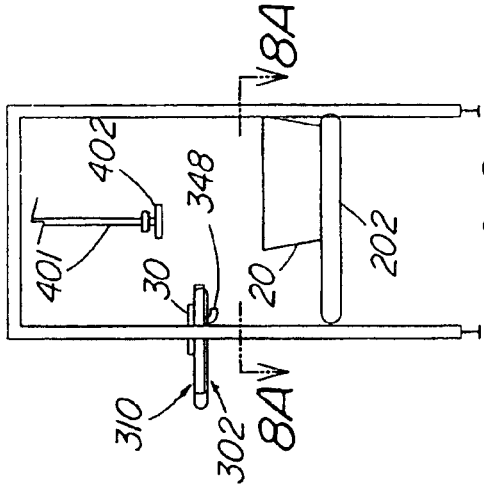

In FIGS. 8 and 8A, the package 30 is approaching the right end of the constant motion band conveyor and the pneumatic lifter cylinder 352 of the package lifter mechanism 352 is about to be activated causing the package 30 to be elevated above the surface of the constant motion band conveyor 302. Also, a vacuum is about to be supplied to the vacuum plenum device 350, which will stop the horizontal movement of the package and hold it in contact with the perforated surface of the vacuum plenum device 350. The container or case has moved from its home position along the longitudinal axis of the horizontal belt conveyor 202 and is now located at its rear position. The horizontal belt conveyor 202 is shown at its home or central position but could, of course, be moved to the right or left positions depending on the pack pattern.

Figure 9A:
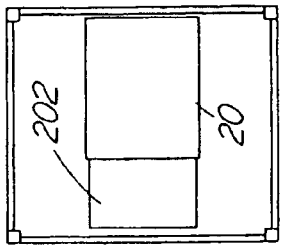
FIGS. 7 through 12 and FIGS. 7A through 12A are a series of schematic views representing the handling sequence of a package after it has been received by the package infeed system.
Figure 9:
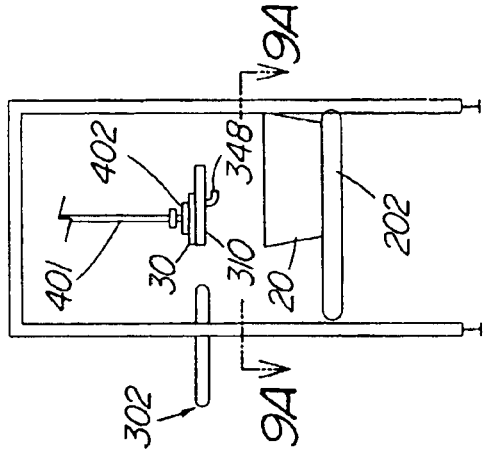

In FIGS. 9 and 9A, the servo motor 312 has been energized, causing the timing belts 328 to shift the vacuum transfer mechanism 310 toward the back of the machine to a location at which the package 30 is located at the stationary package placement location below the vacuum head 402. The vacuum to the vacuum plenum device 352 has been turned off. The constant motion band conveyor 302 is waiting for the next package to arrive. The spindle 401 and vacuum head 402 have the vacuum on and have been lowered to the pick up position. The container or case 20 has not been moved from its position in FIG. 8.

Figures 10, 10A, 11, 11A, 12, 12A, 13, 13A:
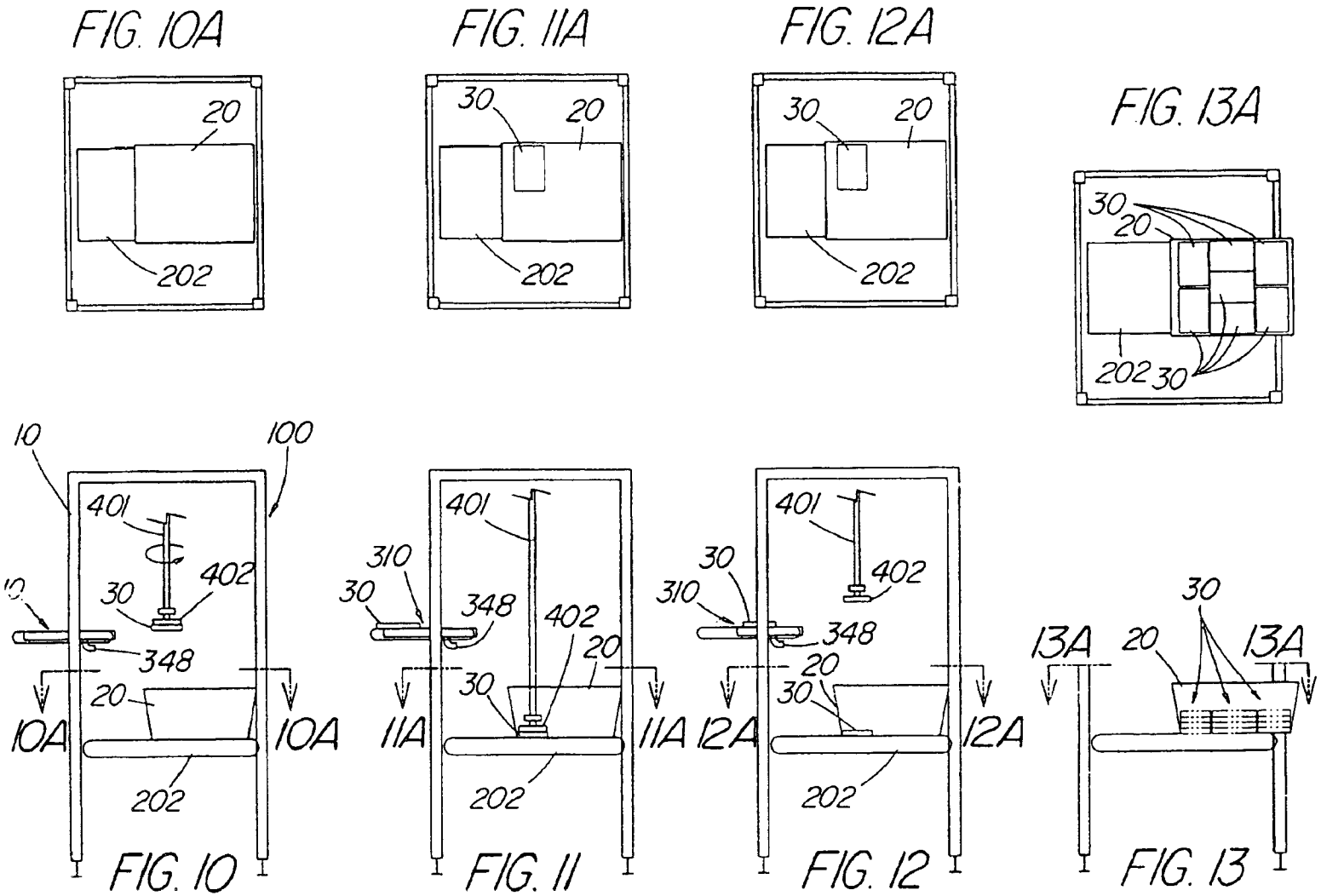
FIGS. 13 and 13A are side and top views of the machine showing containers that have been filled.

In FIG. 10, the vacuum transfer mechanism 310 has been shifted back into its nested position within the constant motion band conveyor 302. The vacuum for the vacuum plenum device 350 is off and a second package 30 has been recognized and is about to be received by the constant motion band conveyor 302. Although the cycle for the first package has not been completed, a second cycle has been initiated for the second package 30. The pneumatic lifter cylinder 352 has not been actuated at this stage and the vacuum for the vacuum plenum device 350 is off. However, the vacuum for the vacuum head 402 is on and the first package is held by the vacuum head 402. The spindle 401 is indicated to be rotating, which allows the orientation of the first package 30 to be changed by 90° to facilitate various pack patterns. The position of the horizontal belt conveyor 202 has been changed through the four bar linkage mechanism that is best seen in FIG. 1. The container or case 20 is now in position to receive the first package 30 in accordance with the pack pattern, and will remain in this position until the first package 30 has been deposited in the container or case 20.

In FIG. 11, the spindle 401 has lowered to the proper depth in the container or case 20. When the spindle 401 reaches the proper depth, the vacuum to the spindle is turned off and the package is released from the vacuum head 402. The package 30 has been received at the left end of the constant motion band conveyor 302.

In FIG. 12, the spindle 401 and vacuum head 402 have been raised to their home or wait positions with the vacuum off. The horizontal belt conveyor 202 remains in the same position, as shown in FIG. 10. The pneumatic lifter cylinder 352 of the package lifter mechanism 352 is about to be activated, causing the package 30 to be elevated above the surface of the constant motion band conveyor 302. Also, a vacuum is about to be supplied to the vacuum plenum device 350 which will stop the horizontal movement of the package and hold it in contact with the perforated surface of the vacuum plenum device 350. The status shown in FIG. 12 is the same as shown in FIG. 8, except the container or case 20 is in a different location and the first package has been deposited in the container in accordance with the pack pattern.

FIGS. 13 and 13A show side and top views of the horizontal belt conveyor 202 with a container that has been filled with packages in the desired pack pattern. The full container is fed by the horizontal belt conveyor 202 out the back of the machine 100 (to the right as seen in FIG. 13) to a removal conveyor, and an empty container or case 20 is fed to the horizontal belt conveyor 202 from the front of the machine 100.

Figure 14:
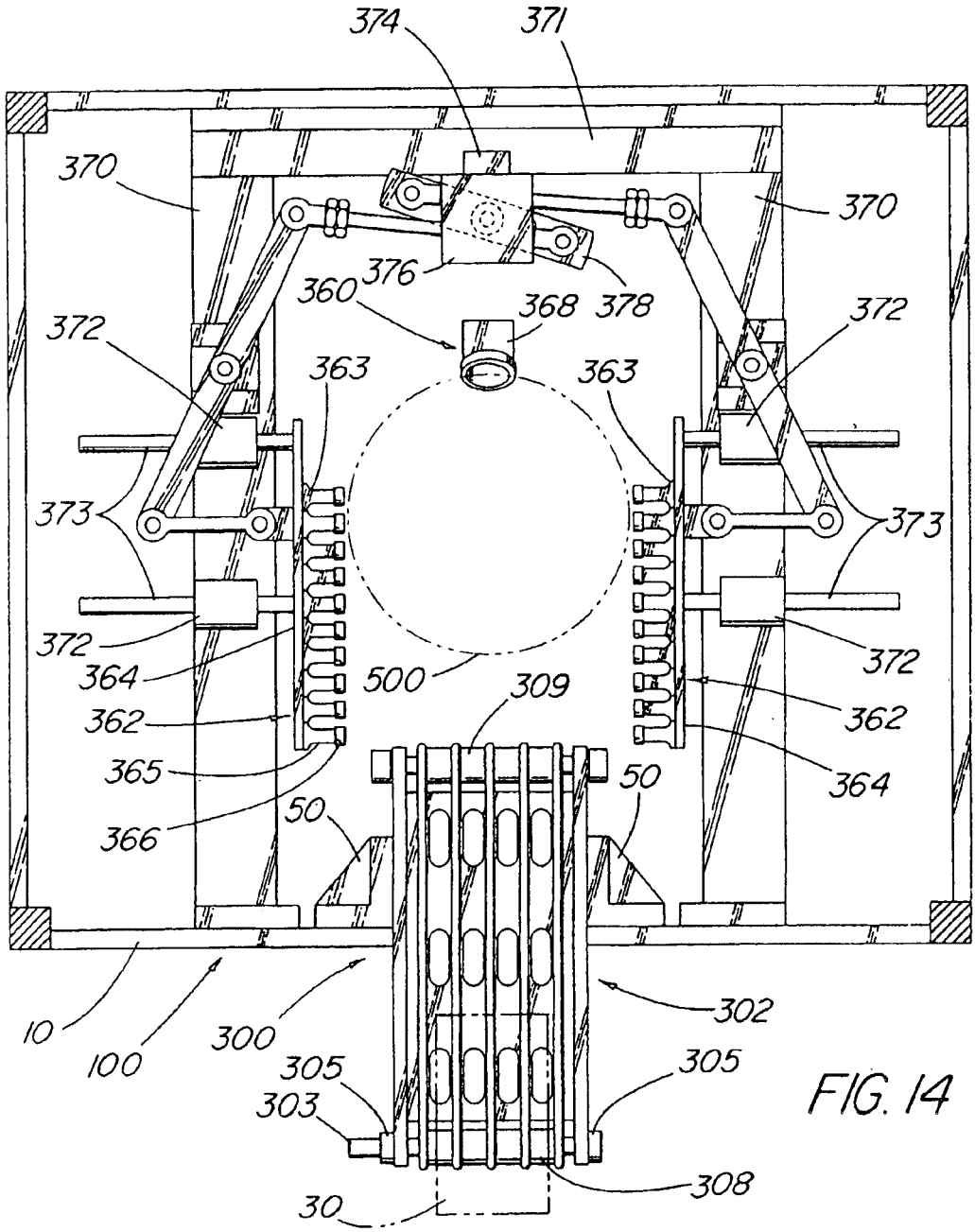
FIGS. 14–20 disclose a second embodiment of the invention.
Figure 15:
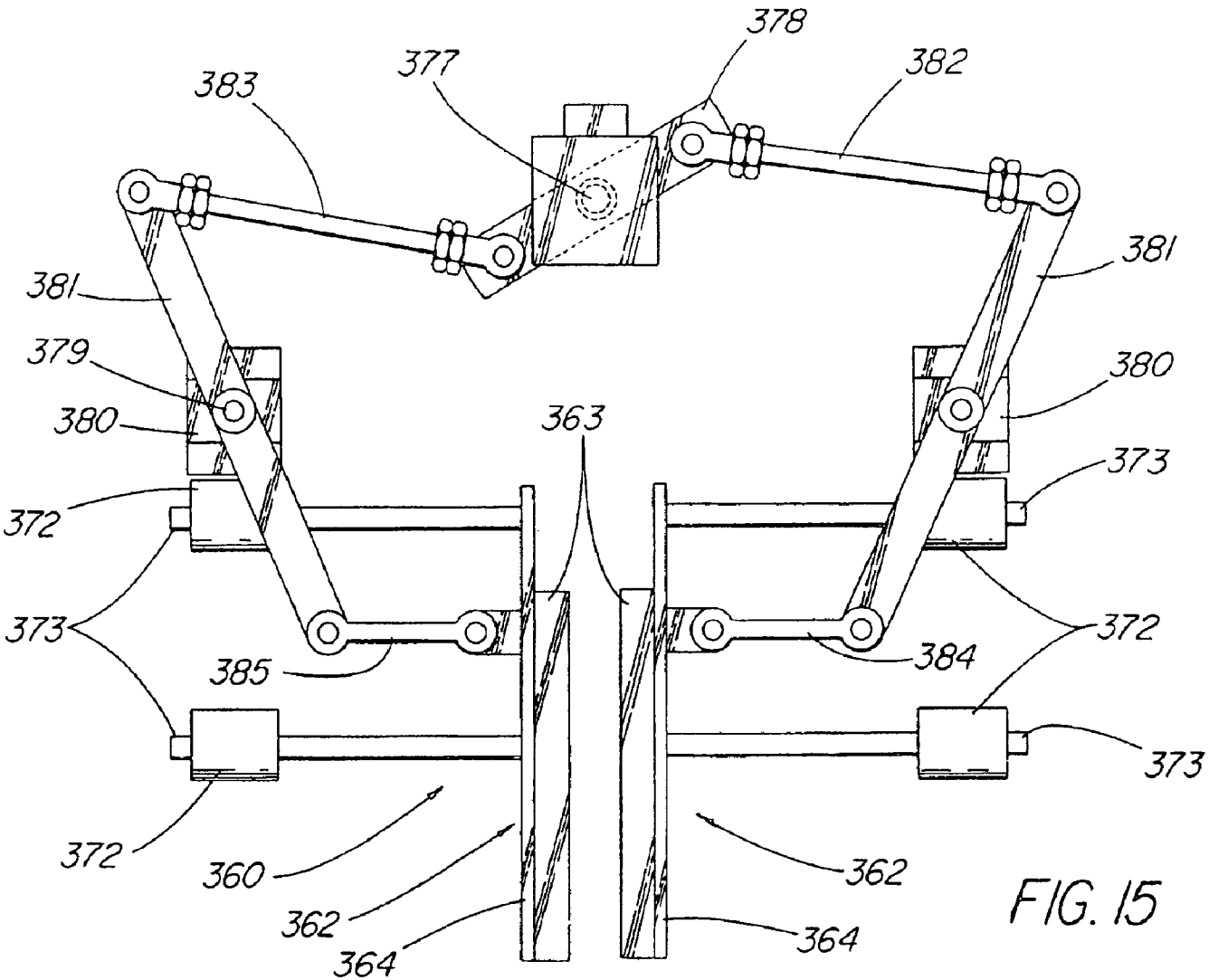
Figure 17:
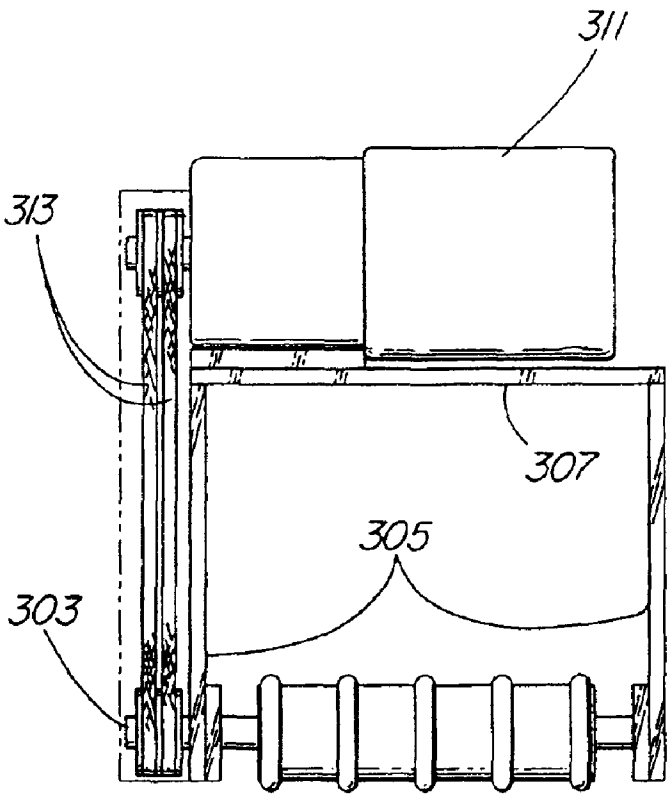
Figure 16:
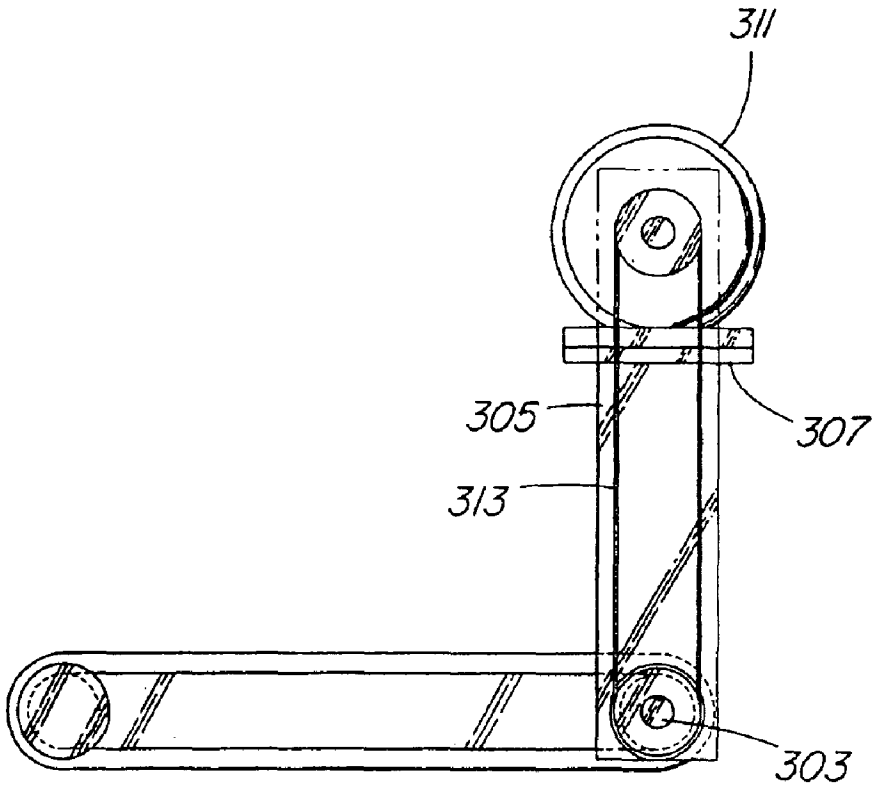

Another embodiment of the package infeed system 300 is shown in FIGS. 14–20. This embodiment includes a constant motion band conveyor 302 and a package detection system 50 similar to that used in the previous embodiment. The drive for band conveyor 302 in this embodiment differs from the drive disclosed in the previous embodiment. The drive input shaft 303 and motor support plates 305 are shown in FIGS. 14, 16 and 17. As best seen in FIGS. 16 and 17, the motor support plates 305 support a horizontal motor mounting plate 307 on which is mounted the drive motor 311. Drive is transmitted from the drive motor 311 to the drive input shaft 303 by a cog drive belt 313.

This embodiment of the package infeed system 300 is mounted on a machine 100, having a main frame 10 of the type shown in the previous embodiment and functions in cooperation with the case conveyor system 200, package placement vertical drive system 400, and the stationary package placement location 500 of the type disclosed in the previous embodiment. For this reason, the case conveyor system 200 and the package placement vertical drive system 400 are not shown in this second embodiment of the invention. The package locating system 360 of this embodiment differs from that vacuum transfer mechanism 310 used in the prior embodiment.

Referring now to FIG. 14, the constant motion band conveyor 302 receives packages 30 from a conveyor (not shown) in a random fashion. The conveyor 302 has a spool-like member 308 at its receiving end and a second spool-like member 309 at its discharge end over which bands extend. The conveyor 302 is driven by motor 311 for which the speed can be adjusted. Other types of adjustable speed constant motion conveyors could be used. The speed of conveyor 302 is adjusted such that it will propel or slide the package 30 horizontally from its discharge end toward the stationary package placement location 500.

A pair of package slide members 362 are located downstream of the discharge end of the conveyor 302. The package slide members 362 are moveable between the positions shown in FIG. 14 and FIG. 15. When the package is discharged from the discharge end of conveyor 302, the package slide members 362 are in their closed position shown in FIG. 15, but not engaging. Each of the package slide members 362 has a vertically extending flange 364 and a horizontally extending member 363. As seen in FIG. 14, the horizontally extending members 363 has horizontally extending flanges formed by a plurality of horizontally extending fingers 365, each of which supports a roller 366 that is mounted to freely rotate, thus providing a low friction surface for receiving the packages that are propelled or slid from the discharge end of conveyor 302. As seen in FIG. 15, the horizontally extending flanges are in the form of flat plates formed from low friction plastic material. The FIG. 15 type of horizontally extending members are preferred for lighter packages 30, and the FIG. 14 type of horizontally extending members are preferred for heaver packages 30. Both versions of the package slide members 362 form a channel-shaped receptor for the packages 30, having a low friction horizontal surface. The momentum of the packages causes them to continue to move toward the center of the stationary package placement location 500. As will be further discussed, the leading end of a package 30 will encounter a vacuum stop and placement member 368 that is shown in FIG. 14 (but has not been shown in FIG. 15 in an effort to simplify that view).

FIG. 15 is an isolated view of the package slide mechanisms 362 and the means for causing them to move back and forth between the positions, as seen in FIGS. 14 and 15.

The main frame 10 of the machine 100 includes a pair of fore-and-aft extending frame members 370 each of which has two guides 372 secured thereto. Each guide 372 has a horizontal bore formed therein that slidabably receives a rod 373 that is secured to the package slide members 362. Each of the package catching members 362 has a pair of rods 373 that extend through the horizontal bores formed in the guides 372 thus guiding the package slide members 362 as they reciprocate between the positions, as shown in FIGS. 14 and 15.

Figure 18:
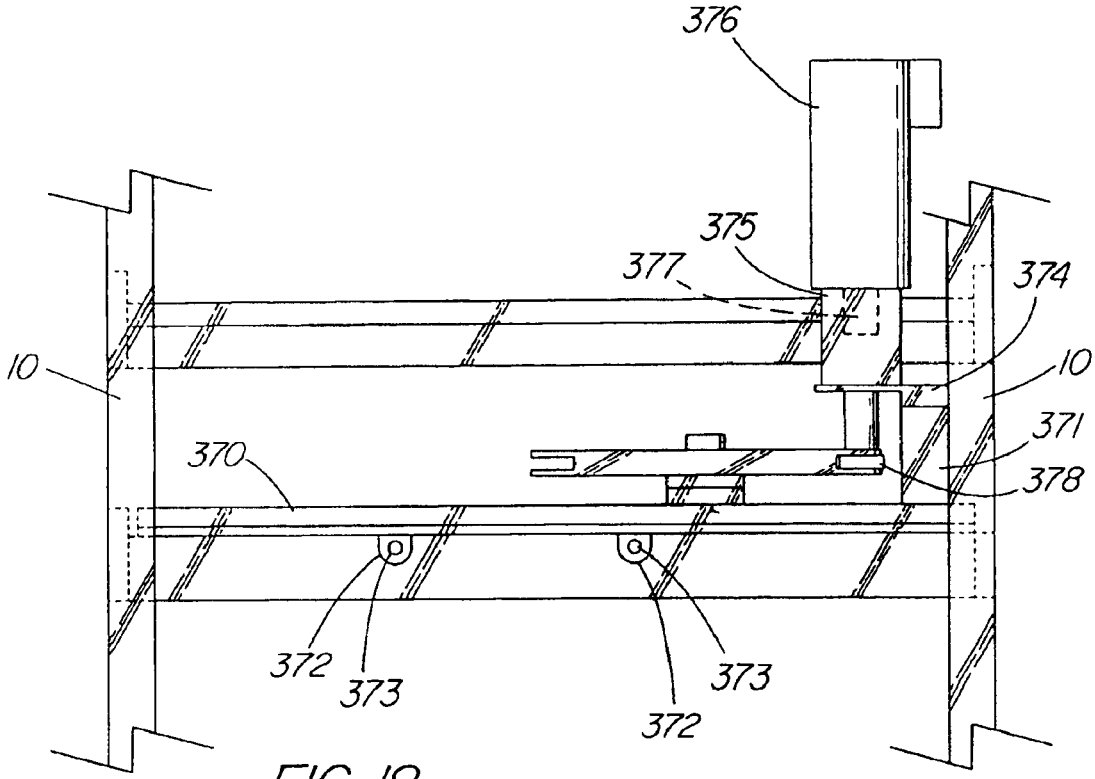

The mechanism for imparting sliding movement to the package slide members 362 will be discussed with reference to FIGS. 14, 15 and 18. FIG. 18 is a partial right-side view of the machine 100, similar to FIG. 2, but modified to show features of this embodiment. FIG. 15 is an isolated plan view of the package slide members 362 and mechanism for imparting sliding movement thereto. As best seen in FIG. 14, the main frame 10 of the machine 100 includes a horizontal supplemental frame member 371 that is secured at each free end to one of the fore-and-aft extending frame members 370. A motor mount member 374 is secured centrally of the supplemental frame member 371, and includes an upwardly extending portion 375. A servo motor 376 is supported on the motor mount member 374 at the upper end of the upwardly extending portion 375. The drive shaft 377 of the servo motor 376 extends through the upwardly extending portion 375 and through a central opening in the motor mount member 374. A double-arm member 378 is secured to the free end of the drive shaft 377 and is caused to oscillate by the servo motor 376.

A pivot post 380 is secured to each of the fore-and aft extending frame members 370, upon which an elongated pivot bar 381 is centrally mounted for pivoting about a vertical pivot axis 379. A link member 382 is pivotally connected at one end to a free end of the double arm 378 and at its other end to a free end of one of the elongated pivot bars 381. A second link member 383 extends between the other free end of the double arm 378 and a free end of the other elongated pivot bar 381. The other free end of the elongated pivot bar 381 that is connected to link members 382 is connected by a link member 384 to the associated package slide member 362. The other free end of the elongated pivot bar 381 that is connected to link member 383 is connected by a link member 385 to the associated package slide member 362. Link member 378 can be rotated by the servo motor 376 such that package slide members 362 are set for any package width within the machine's range. Also, link 378 can be set, through servo motor 376, to cause the package slide members 362 to open to a width that will allow the packages to be rotated while passing between the package slide members 362.

Figure 20:
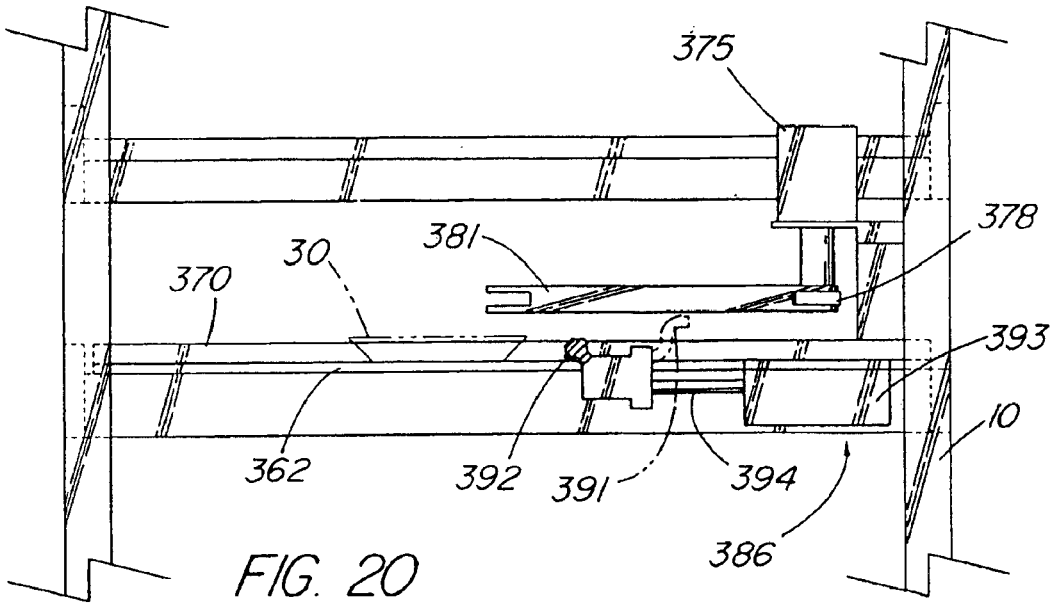
Figure 19:
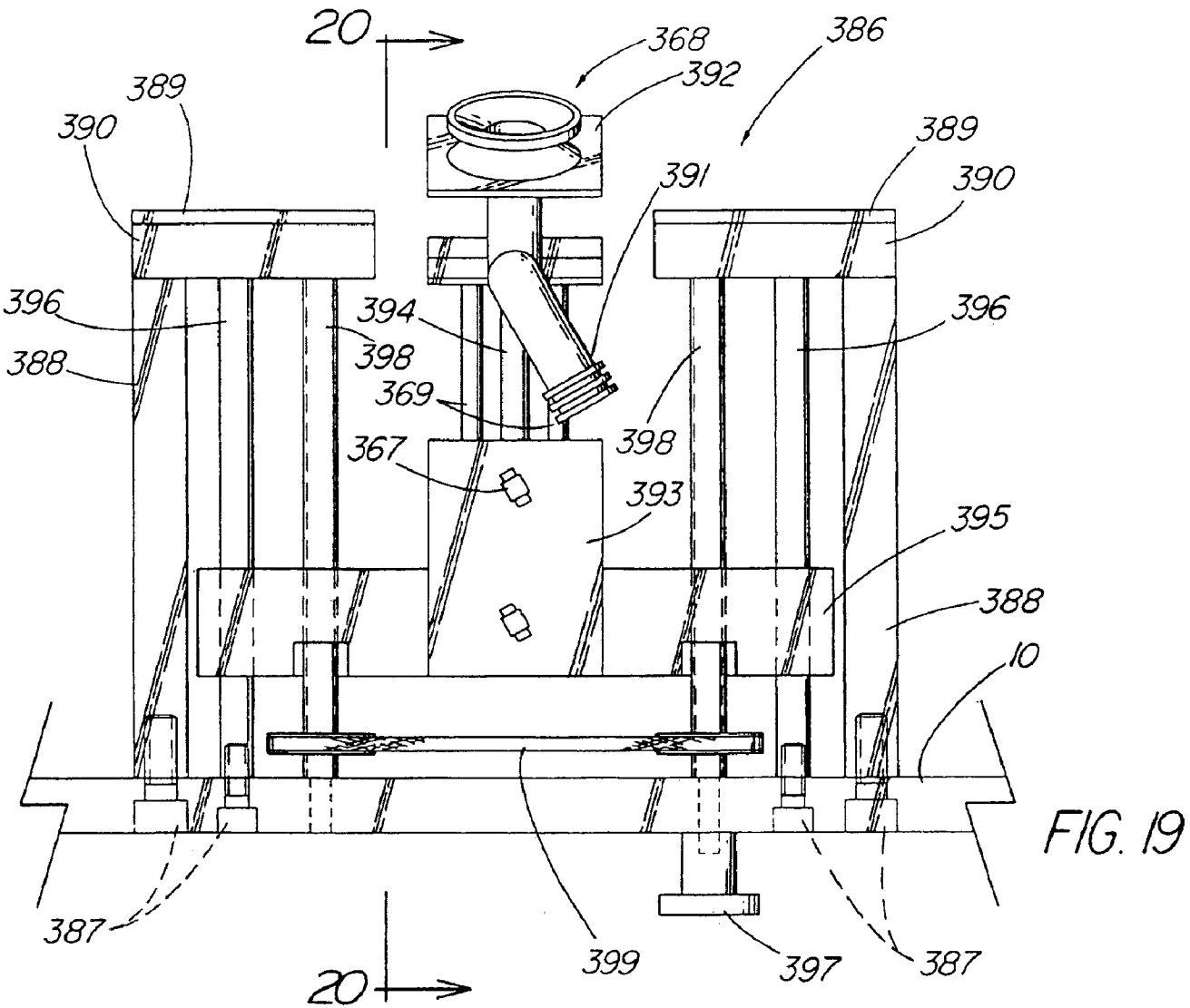

The assembly 386 for slidably mounting the vacuum stop and placement member 368 will be discussed with reference to FIGS. 19 and 20. FIG. 20 is a partial right-side view of the machine 100, similar to FIG. 18, with portions of the drive mechanism for the package slide members 362 removed to better illustrate the vacuum stop and placement member 368 and its support assembly 386. In FIG. 20, the assembly 386 is shown as a cross-section view taken along lines 20—20 of FIG. 19. FIG. 19 is an isolated plan view of the support assembly 386, showing it secured to a horizontally extending portion of the main frame 10 by fasteners 387. A pair of support legs 388 that are secured to the frame 10 by fasteners 387 extend horizontally toward the front of the machine 100. The free ends of legs 388 are secured to plates 389. A pair of support blocks 390 are secured to the support legs 388 and the surface of the plate 389.

The vacuum stop and placement member 368 has a flexible tube 391 connected thereto through which a vacuum is provided to an opening formed in its inclined face 392. The opening in inclined face 392 is located to intercept and grasp packages 30 as they slide rearwardly through the channel-shaped package receptor supported by the package slide mechanism 362. As seen in FIG. 20, a package 30 is supported on package slide mechanism 362 as the package moves toward the inclined face 392 of the vacuum stop and placement member 368. A pair of slide rods 369 extend rearwardly from the vacuum stop and placement member 368 into bores formed in an air cylinder 393 that function to guide vacuum stop and placement member 368, as it is caused to reciprocate by the air cylinder 393. Air cylinder 393 is of the type called a linear thruster and has a reciprocating rod 394 and air fixtures 367. Pressurized air is provided to the air cylinder 393 through fixtures 367 causing reciprocation of the rod 394. The free end of rod 394 is secured to the vacuum stop and placement member 368.

The air cylinder 393 is secured to a mounting member 395 that is slidably mounted on support rods 396. The support rods 396 are secured to the main frame 10 at one of their ends and to the support blocks 390 at their other ends. This mounting arrangement allows the air cylinder 393 and its mounting member 395 to be moved forward and backward by sliding on the support rods 396, and thus, permit forward and rearward movement of the location of the vacuum stop and placement member 368. Adjustment of the location of the vacuum stop and placement member 368 is accomplished by turning a knurled knob 397, which causes rods 398 that are threaded into threaded apertures formed in the mounting member 395 to move the air cylinder mounting member 395 fore and aft. The rods 398 are interconnected by a cog belt 399 that transmits the rotation of the rod 398 to which the knurled knob is secured to the other rod 398, and thus, synchronizes the rotation of rods 398.

The operation of the embodiment disclosed in FIGS. 14–20 will now be discussed.

Packages 30 are deposited on the constant motion band conveyor 302 in a random fashion from a conveyor (not shown). The constant motion band conveyor 302 moves at a faster speed than the conveyor that feeds packages to it. As a package 30 moves along constant motion band conveyor 302, its presence is sensed by the package detection system 50 which initiates the cycle for that particular package 30. A signal is sent to the PLC 60, indicating that a new package 30 has been detected and a new cycle must be commenced. If the package slide mechanism 362 isn't already in the closed position, as shown in FIG. 15, then a signal is sent to servo motor 376 telling it to rotate clockwise, as seen in FIG. 14, which will cause the package slide members 362 to move from the position shown in FIG. 14 to the closed position shown in FIG. 15. Also, if the vacuum stop and placement member 368 is not already in its full forward position, a signal is sent to the valve for the air cylinder 393, causing the reciprocating rod 394 to move to its fully extended position, as shown in FIG. 20. When a package 30 is discharged over the discharge end of constant motion band conveyor 302 with the package slide mechanism 362 in the position shown in FIG. 15, the package will land on the horizontally extending flanges of the package slide members 362 and slide along its upper surface. As the package 30 moves toward the rear of the machine 100, it encounters the vacuum stop and placement member 368. The package 30 is held by the vacuum stop and placement member 368. The vacuum to the vacuum head 402 carried by the spindle 401 is turned on and the spindle 401 moves downward. The vacuum to the vacuum stop and placement member 368 is turned off, the vacuum stop member 368 moves back and the package is grasped by the vacuum head 402 on the spindle 401. The spindle 401, with the package 30 held by the vacuum head 402, moves up and rotates if the program calls for this package to be rotated. The cycle that has been selected for a particular job includes a predetermined time period that is an estimation of how long the package will take to move from where it is detected on the constant motion band conveyor 302 to the vacuum stop and placement member 368. When this time period plus some factor of safety has expired, the PLC 60 sends signals to the servo motor 376 and the valve for the air cylinder 393. These signals cause package slide members 362 to open and the vacuum stop and placement member 368 to retract. While these members are moving out of the stationary package placement location 500, the spindle 401 raises a short distance and then moves downward, after the area has been opened, and lowers the package 30 into the awaiting container 20. Since the completion of the previous cycle, the container 20 may have moved to a new location, or if filled, it would have been replaced by an empty container. When the spindle 401 reaches its programmed level in the container, its vacuum is turned off. The package 30 is released and the spindle 401 and its vacuum head 402 are elevated to a location above the level of the package slide members 362. All of the above-mentioned functions are initiated by signals from the PLC 60. The next cycle begins when the next package is recognized by the detection system.

It is intended that the accompanying drawings and foregoing detailed description are to be considered in all respects as illustrative and not restrictive. The scope of the invention is intended to embrace any equivalents, alternatives, and/or modifications of elements that fall within the spirit and scope of the invention, and all changes which come within the meaning and range of equivalency of the claims are therefore intended to be embraced therein.

What is claimed is:

1. A pick-and-place machine for loading packages into cases in a predetermined pack pattern comprising:

a programmable logic controller for operating the components of the pick-and-place machine;

a frame;

a package infeed system adapted to receive packages to be placed into cases in a predetermined pack pattern, said predetermined pattern being under the control of said programmable logic controller that can include packages extending normal to each other, said package infeed system including a conveyor that is fixed to said frame and conveys the received packages along an infeed direction and a drive mechanism for driving said conveyor at a constant speed;

a package locating mechanism that receives packages from said package infeed system and supports the packages at a stationary package placement location;

a case conveyor including conveying and shifting mechanism capable of moving a case such that said stationary package placement location can be located over any location within said case, said conveying mechanism functioning to move the case along the longitudinal axis of the case conveyor in either direction, and said shifting mechanism functioning to shift the case in either direction normal to the longitudinal axis of the case conveyor;

a package placement vertical drive mechanism that grasps a package as said package is supported by said package locating mechanism at the said stationary package placement location;

a mechanism for retracting said package locating mechanism away from the stationary package placement location and the package to remove said support for said package and prevent interference with said vertical drive mechanism after said vertical drive mechanism has grasped the package;

said vertical drive mechanism functioning to lower the package through the stationary package placement location into the case after the package locating mechanism has been retracted away from the stationary package placement location and the package.

2. A pick-and-place machine for loading packages into cases in a predetermined pack pattern as recited in claim 1 and further comprising:

a mechanism for elevating said package placement vertical drive mechanism after it has grasped the package and before it lowers the package into the case.

3. A pick-and-place machine for loading packages into cases in a predetermined pack pattern as recited in claim 1 and further comprising:

a mechanism for rotating said package placement vertical drive mechanism after it has grasped the package and before it releases the package into the case.

4. A pick-and-place machine for loading packages into cases in a predetermined pack pattern as recited in claim 2 and further comprising:

a mechanism for rotating said package placement vertical drive mechanism after it has grasped the package and before it releases the package into the case.

5. A pick-and-place machine for loading packages into cases in a predetermined pack pattern as recited in claim 1 and further comprising:

said package locating mechanism including a mechanism for elevating the package above the surface of said conveyor.

6. A pick-and-place machine for loading packages into cases in a predetermined pack pattern as recited in claim 5 and further comprising:

said package locating mechanism including a pneumatic mechanism for grasping said package and stopping its movement along the infeed direction relative to the package locating mechanism.

7. A pick-and-place machine for loading packages into cases in a predetermined pack pattern as recited in claim 6 and further comprising:

said package locating mechanism locating the package at the stationary package placement location after the package has been elevated above the surface of said conveyor and after its movement along the infeed direction relative to the package locating mechanism has been stopped.

8. A pick-and-place machine for loading packages into cases in a predetermined pack pattern as recited in claim 1 and further comprising:

the speed of said drive mechanism for driving said conveyor at a constant speed being adjustable to other constant speeds.

9. A pick-and-place machine for loading packages into cases in a predetermined pack pattern as recited in claim 1 and further comprising:

said package placement vertical drive mechanism gripping the package by vacuum and including a quick attach and detach vacuum head which enables the rapid change over of the system.

10. A pick-and-place machine for loading packages into cases in a predetermined pack pattern as recited in claim 1 and further comprising:

said package locating mechanism including package slide members that have horizontal low friction surfaces that receive the packages moving in the infeed direction from said package infeed system and a mechanism for stopping the movement of the packages at the stationary package placement location.

11. A pick-and-place machine for loading packages into cases in a predetermined pack pattern as recited in 10 and further comprising:

said mechanism for stopping the movement of the packages at the stationary package placement location being a pneumatic device that grasps and holds the package.

12. A pick-and-place machine for loading packages into cases in a predetermined pack pattern as recited in claim 10 and further comprising:

said package slide members and said mechanism for stopping the movement of the packages at the stationary package placement location being movable away from their locations at which they are supporting and holding the package at the stationary package placement location to permit the package placement vertical drive, which grasps the package at the stationary package placement location, to lower the package into the case.

13. A pick-and-place machine for loading packages into cases in a predetermined pack pattern as recited in claim 10 and further comprising:

the horizontal low friction surfaces of said package slide members being formed of plastic sheets having a low coefficient of friction.

14. A pick-and-place machine for loading packages into cases in a predetermined pack pattern as recited in claim 10 and further comprising:

the horizontal low friction surfaces of said package slide members being formed of plates having a plurality of horizontal fingers supporting rollers at their free ends.

15. The method of loading packages in a predetermined pack pattern and packaging sequence into containers comprising the steps of:

feeding packages to be loaded into containers to a constant speed conveyor;

providing a package locating mechanism;

transferring a package from the conveyor to a stationary package placement location with the package locating mechanism;

utilizing the package locating mechanism to support each package at the stationary package placement location;

grasping each package from above at the stationary package placement location;

maneuvering a container under the stationary package placement location such that the grasped package is directly above the location in the predetermined pack pattern where the next package in the packaging sequence is to be deposited;

moving the package locating mechanism away from the stationary package placement location and the grasped package;

lowering the grasped package vertically through the package placement location and into the container after performing the step of moving the package locating mechanism away from the stationary package placement location and the grasped package; and releasing the package at the predetermined location in accordance with the predetermined pack pattern and packaging sequence.

16. The method of loading packages in a predetermined pack pattern and packaging sequence into containers as set forth in claim 15 comprising the additional step of:

elevating the package after it has been grasped from above.

17. The method of loading packages in a predetermined pack pattern and packaging sequence into containers as set forth in claim 15 comprising the additional step of:

rotating the package about a vertical axis after it has been grasped from above.

18. The method of loading packages in a predetermined pack pattern and packaging sequence into containers as set forth in claim 16 comprising the additional step of:

rotating the package about a vertical axis after it has been grasped from above.

19. The method of loading packages in a predetermined pack pattern and packaging sequence into containers as set forth in claim 15 comprising the additional steps of:

restricting the movement of the package relative to the package locating mechanism; and elevating the package before it has been grasped from above.

20. The method of loading packages in a predetermined pack pattern and packaging sequence into containers as set forth in claim 19 comprising the additional step of:

releasing the package from the package locating mechanism after it has been elevated and before it has been grasped from above.

21. The method of loading packages in a predetermined pack pattern and packaging sequence into containers as set forth in claim 20 comprising the additional step of:

rotating the package about a vertical axis after it has been grasped from above.

22. The method of loading packages in a predetermined pack pattern and packaging sequence into containers as set forth in claim 20 comprising the additional step of:

elevating the package after it has been grasped from above.

23. The method of loading packages in a predetermined pack pattern and packaging sequence into containers as set forth in claim 15 comprising the additional steps of:

sensing the presence of each package on the conveyor;

transmitting the sensed information to a programmable logic controller; and transmitting signals from the programmable logic controller to machine components that perform the steps of the loading packages in a predetermined pack pattern and packaging sequence into containers.

24. The method of loading packages in a predetermined pack pattern and packaging sequence into containers as set forth in claim 15 comprising the additional steps of:

receiving the package at the package locating mechanism from the conveyor on a low friction horizontal surface over which the package slides; and stopping and holding the sliding package at the stationary package placement location.

25. The method of loading packages in a predetermined pack pattern and packaging sequence into containers as set forth in claim 24 wherein the step of moving the package locating mechanism away from the stationary package placement location and the grasped package occurs after the package has been grasped from above, and includes the steps of:

retracting the low friction horizontal surface that received the package from the conveyor; and releasing the package from the mechanism that stopped and held the sliding package at the stationary package placement location.

26. The method of loading packages in a predetermined pack pattern and packaging sequence into containers as set forth in claim 24 comprising the additional step of:

elevating the package after it has been grasped from above.

27. The method of loading packages in a predetermined pack pattern and packaging sequence into containers as set forth in claim 24 comprising the additional step of:

rotating the package about a vertical axis after it has been grasped from above.

28. The method of loading packages in a predetermined pack pattern and packaging sequence into containers as set forth in claim 26 comprising the additional step of:

rotating the package about a vertical axis after it has been grasped from above.

29. A pick-and-place machine for loading packages into cases in a predetermined pack pattern comprising:

a programmable logic controller for operating the components of the pick-and-place machine;

a frame;

a package infeed system adapted to receive packages to be placed into cases in a predetermined pack pattern, the predetermined pattern being under the control of the programmable logic controller that can include packages extending normal to each other, the package infeed system including a conveyor that is fixed to the frame and conveys the received packages along an infeed direction and a drive mechanism for driving the conveyor at a constant speed;

a package locating mechanism that transfers packages from the package infeed system to a stationary package placement location and supports the packages at the stationary package placement location;

a case conveyor including conveying and shifting mechanism capable of moving a case such that the stationary package placement location can be located over any location within the case, the conveying mechanism functioning to move the case along the longitudinal axis of the case conveyor in either direction, and the shifting mechanism functioning to shift the case in either direction normal to the longitudinal axis of the case conveyor;

a package placement vertical drive mechanism that grasps a package at the stationary package placement location, wherein the vertical drive mechanism only moves in a direction normal to the case conveyor;

a mechanism for retracting the package locating mechanism away from the stationary package placement location and the package;

the vertical drive mechanism functioning to lower the grasped package into the case after the package locating mechanism has been retracted away from the stationary package placement location and the package.

30. A pick-and-place machine for loading packages into cases in a predetermined pack pattern comprising:

a programmable logic controller for operating the components of the pick-and-place machine;

a frame;

a package infeed system adapted to receive packages to be placed into cases in a predetermined pack pattern, the predetermined pattern being under the control of the programmable logic controller that can include packages extending normal to each other, the package infeed system including a conveyor that is fixed to the frame and conveys the received packages along an infeed direction and a drive mechanism for driving the conveyor at a constant speed;

a package locating mechanism that transfers packages from the package infeed system to a stationary package placement location, wherein the packages are supported on top of the package locating mechanism at the stationary package placement location;

a case conveyor including conveying and shifting mechanism capable of moving a case such that the stationary package placement location can be located over any location within the case, the conveying mechanism functioning to move the case along the longitudinal axis of the case conveyor in either direction, and the shifting mechanism functioning to shift the case in either direction normal to the longitudinal axis of the case conveyor;

a package placement vertical drive mechanism that grasps a package at the stationary package placement location, wherein the vertical drive mechanism only moves in a direction normal to the case conveyor;

a mechanism for retracting the package locating mechanism away from the stationary package placement location and the package;

the vertical drive mechanism functioning to lower the grasped package into the case after the package locating mechanism has been retracted away from the stationary package placement location and the package.

* * * * *